US008316573B2

(12) United States Patent
Bietsch

(10) Patent No.: US 8,316,573 B2
(45) Date of Patent: Nov. 27, 2012

(54) GUN SIGHT ADJUSTMENT DEVICE

(76) Inventor: Michael B. Bietsch, Rio Rico, AZ (US)

( * ) Notice: Subject to any disclaimer, the term of this patent is extended or adjusted under 35 U.S.C. 154(b) by 210 days.

(21) Appl. No.: 12/687,781

(22) Filed: Jan. 14, 2010

(65) Prior Publication Data

US 2011/0167702 A1 Jul. 14, 2011

(51) Int. Cl.
*F41G 11/00* (2006.01)
*F41C 27/00* (2006.01)

(52) U.S. Cl. ..... 42/124; 42/90; 42/111; 33/274

(58) Field of Classification Search ..... 42/124, 42/111, 137, 143, 90; 33/274, 286
See application file for complete search history.

(56) References Cited

U.S. PATENT DOCUMENTS 5,814,398 A 9/1998 Kronz et al.
5,864,957 A 2/1999 Small
D620,547 S * 7/2010 Bietsch ..... D22/199
2002/0073559 A1 6/2002 Johnson
2002/0152664 A1 10/2002 Mendoza-Orozco
2011/0252688 A1* 10/2011 Bietsch ..... 42/90

OTHER PUBLICATIONS

International Search Report and Written Opinion dated Mar. 21, 2011.

* cited by examiner

*Primary Examiner* — Michael David
(74) *Attorney, Agent, or Firm* — Dale F. Regelman; Nikia L. Gray; Quarles & Brady LLP

(57) ABSTRACT

A device for adjusting a gun sight disposed in a dovetail groove on a gun slide is presented. The device includes a pushing member having a protrusion and an opening formed for receiving the gun sight therethrough, where the pushing member is movable in a first direction. The device further includes a pressure plate moveable in the first direction and a tail assembly opposing the pressure plate and movable in a second direction, where the tail assembly and the pressure plate are for securing the gun slide therebetween. When the gun slide is secured between the tail assembly and the pressure plate, moving the pushing member moves the gun sight.

17 Claims, 11 Drawing Sheets

GUN SIGHT ADJUSTMENT DEVICE

FIELD OF INVENTION

The present invention generally relates to devices for adjusting a sight on a gun, and more specifically relates to devices for adjusting a dovetail sight on pistols.

BACKGROUND

Most pistols are sold with front and rear sights that are each press fit into a dovetail slot on the slide of the pistol. Typically, to adjust or replace the sights a punch and hammer are used to knock the sight left or right as needed. But, even where a non-marring punch is used, the pounding on the sight can distort or break it. Furthermore, if the slide is stabilized using a vice or clamp, the slide can be scratched or marred during the process.

SUMMARY

In one implementation, a device for adjusting a gun sight disposed in a dovetail groove on a gun slide is presented. The device includes a pushing member having a protrusion and an opening formed for receiving the gun sight therethrough, where the pushing member is movable in a first direction. The device further includes a pressure plate moveable in the first direction and a tail assembly opposing the pressure plate and movable in a second direction, where the tail assembly and the pressure plate are for securing the gun slide therebetween. When the gun slide is secured between the tail assembly and the pressure plate, moving the pushing member moves the gun sight.

In another implementation, a method of adjusting a gun sight disposed within a dovetail grove of a gun slide is presented. The method includes supplying a gun sight adjusting device, where the device includes a pushing member having a protrusion and an opening formed for receiving the gun sight therethrough, where the pushing member is movable in a first direction. The device further includes a pressure plate moveable in the first direction and a tail assembly opposing the pressure plate and movable in a second direction, where the tail assembly and the pressure plate are for securing the gun slide therebetween. When the gun slide is secured between the tail assembly and the pressure plate, moving the pushing member moves the gun sight. The method further includes securing the gun slide between the tail assembly and the pressure plate and adjusting the position of the gun sight.

BRIEF DESCRIPTION OF THE DRAWINGS

Implementations of the invention will become more apparent from the detailed description set forth below when taken in conjunction with the drawings, in which like elements bear like reference numerals.

DETAILED DESCRIPTION

This invention is described in preferred embodiments in the following description with reference to the Figures, in which like numbers represent the same or similar elements. Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

The described features, structures, or characteristics of the invention may be combined in any suitable manner in one or more embodiments. In the following description, numerous specific details are recited to provide a thorough understanding of embodiments of the invention. One skilled in the relevant art will recognize, however, that the invention may be practiced without one or more of the specific details, or with other methods, components, materials, and so forth. In other instances, well-known structures, materials, or operations are not shown or described in detail to avoid obscuring aspects of the invention.

The schematic flow charts included are generally set forth as logical flow chart diagrams. As such, the depicted order and labeled steps are indicative of one embodiment of the presented method. Other steps and methods may be conceived that are equivalent in function, logic, or effect to one or more steps, or portions thereof, of the illustrated method. Additionally, the format and symbols employed are provided to explain the logical steps of the method and are understood not to limit the scope of the method. Although various arrow types and line types may be employed in the flow chart diagrams, they are understood not to limit the scope of the corresponding method. Indeed, some arrows or other connectors may be used to indicate only the logical flow of the method. For instance, an arrow may indicate a waiting or monitoring period of unspecified duration between enumerated steps of the depicted method. Additionally, the order in which a particular method occurs may or may not strictly adhere to the order of the corresponding steps shown.

Figure 1:
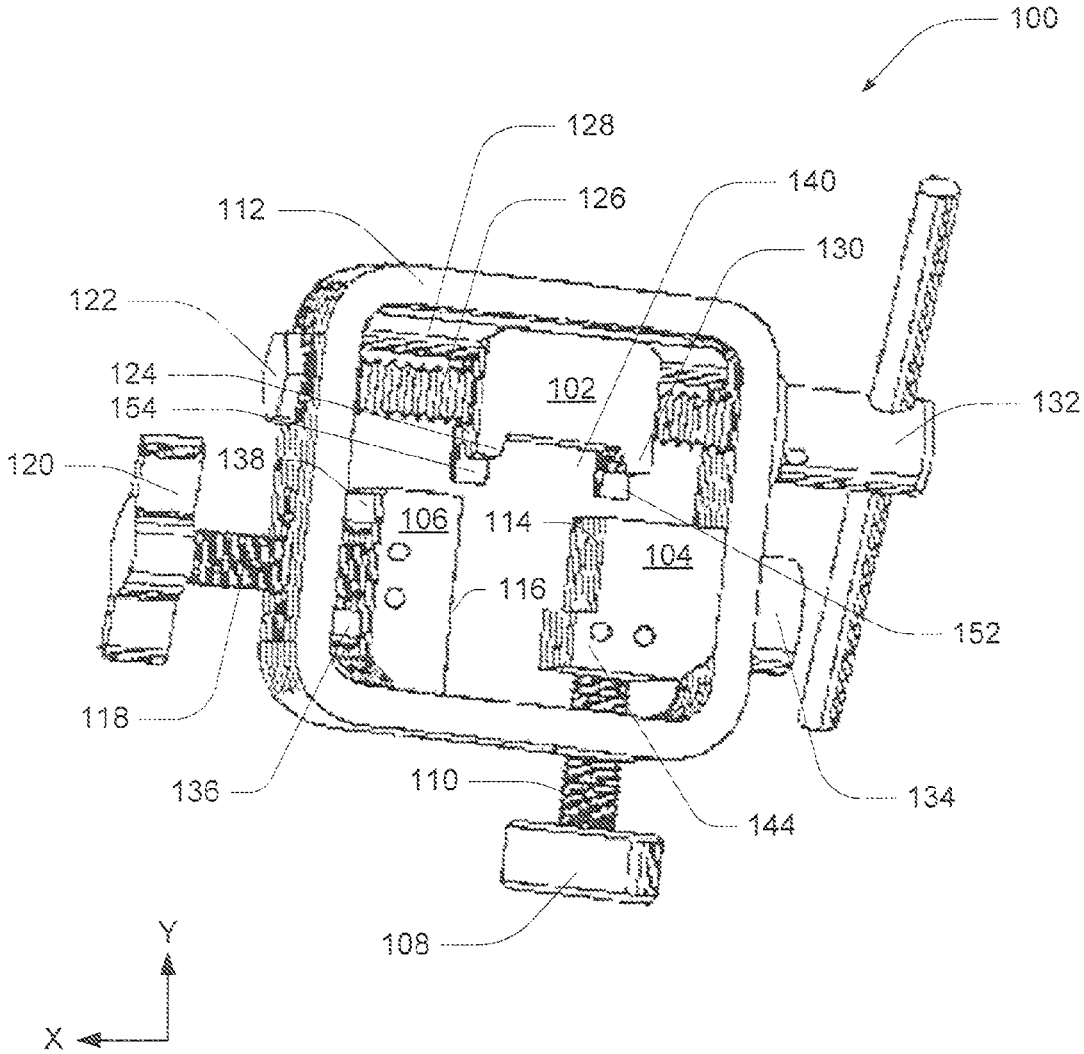
FIG. 1 is a perspective view of an embodiment of a gun sight adjustment device according to the present invention.
Figure 2:
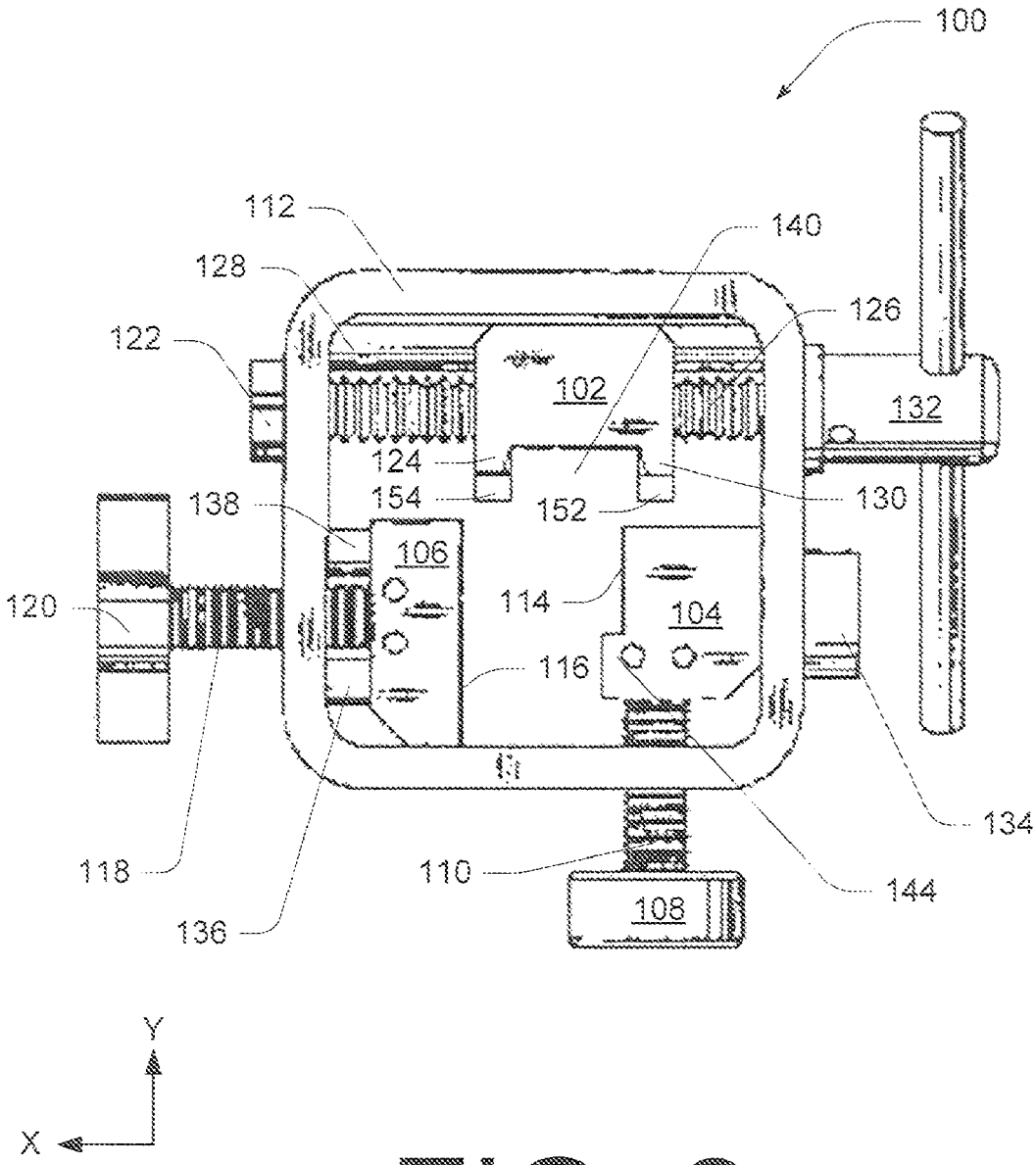
FIG. 2 is a front side elevational view of the gun sight adjustment device of FIG. 1.
Figure 3:
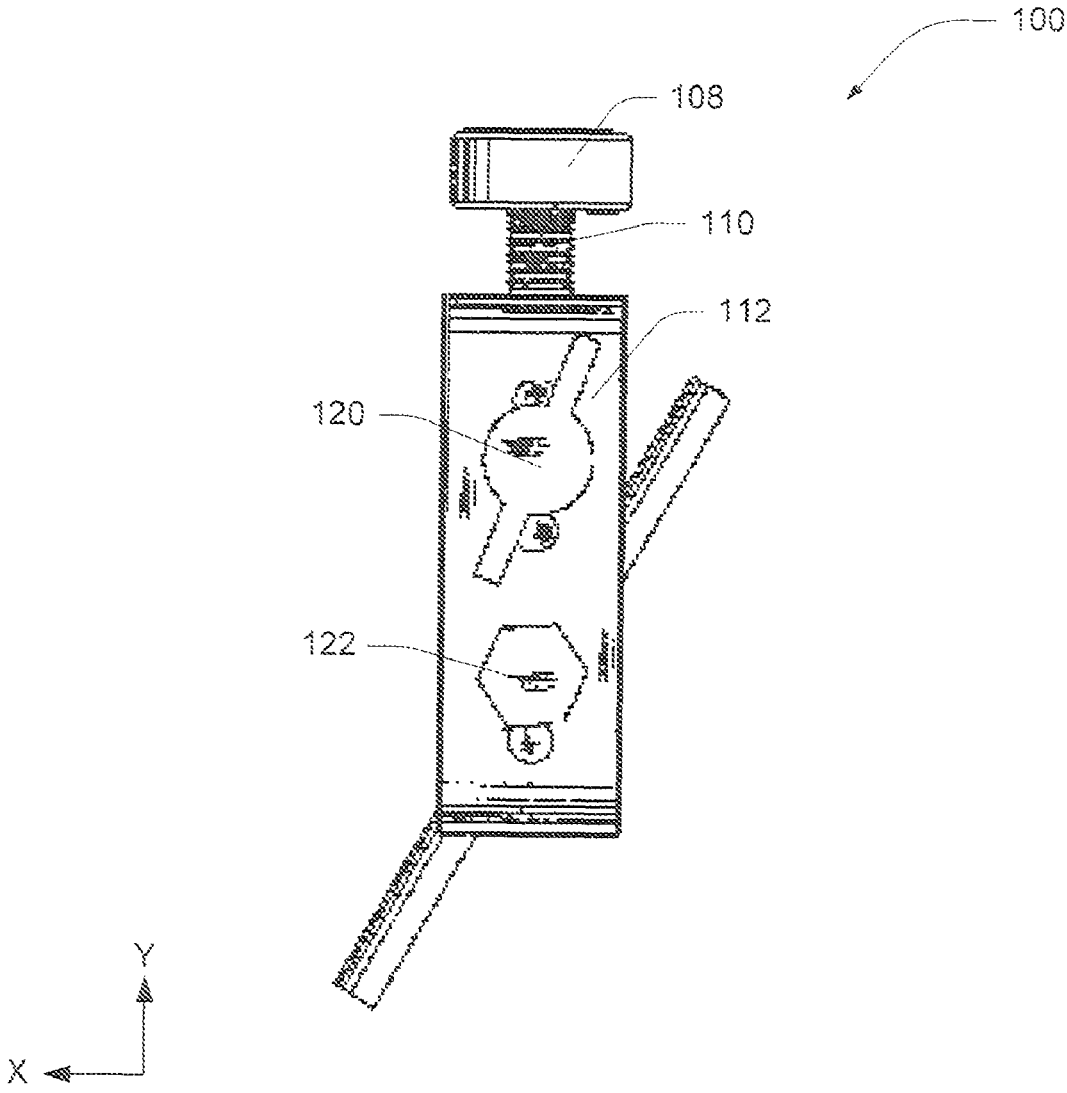
FIG. 3 is a first side view thereof.
Figure 4:
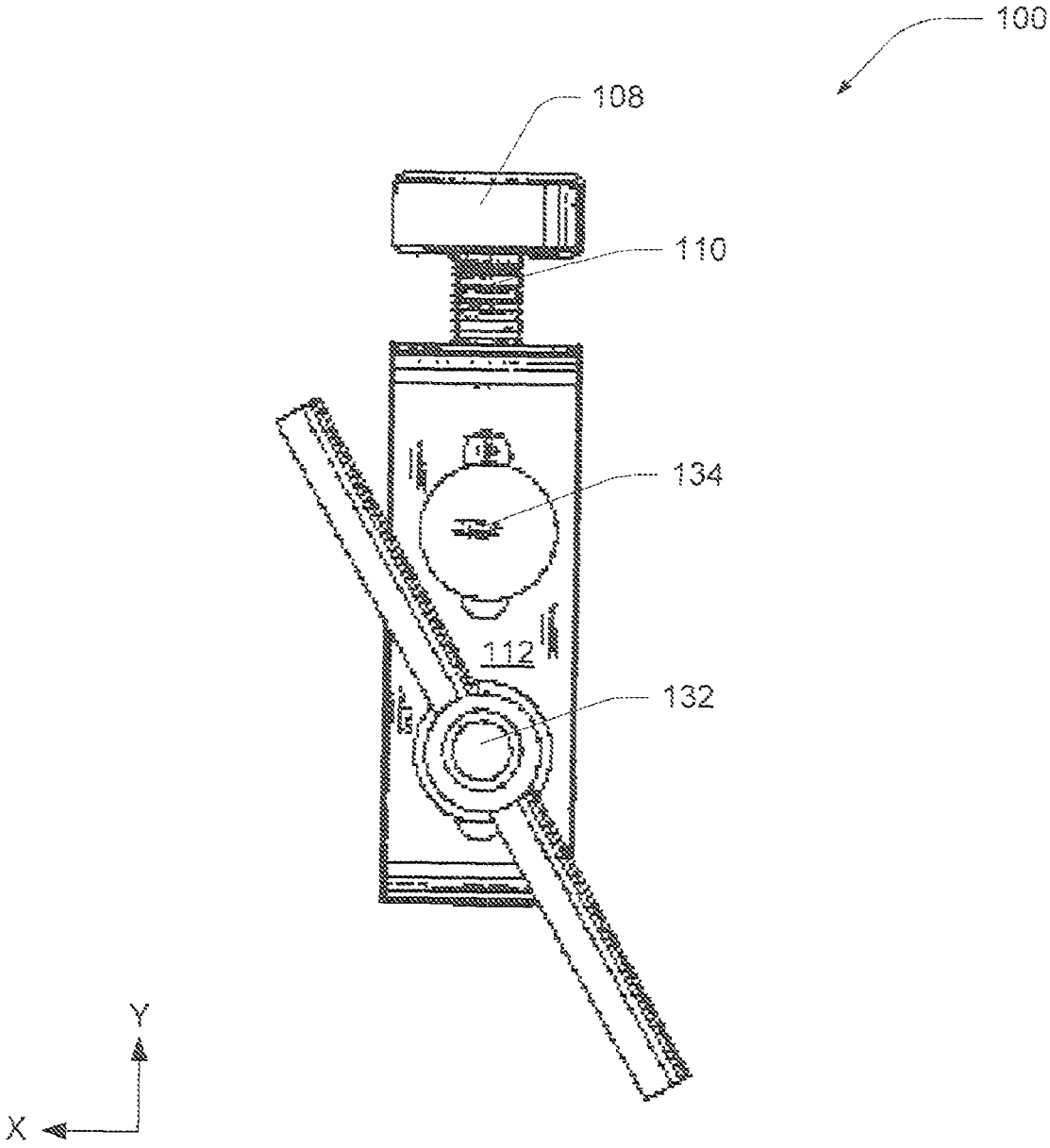
FIG. 4 is a second side view thereof.
Figure 5:
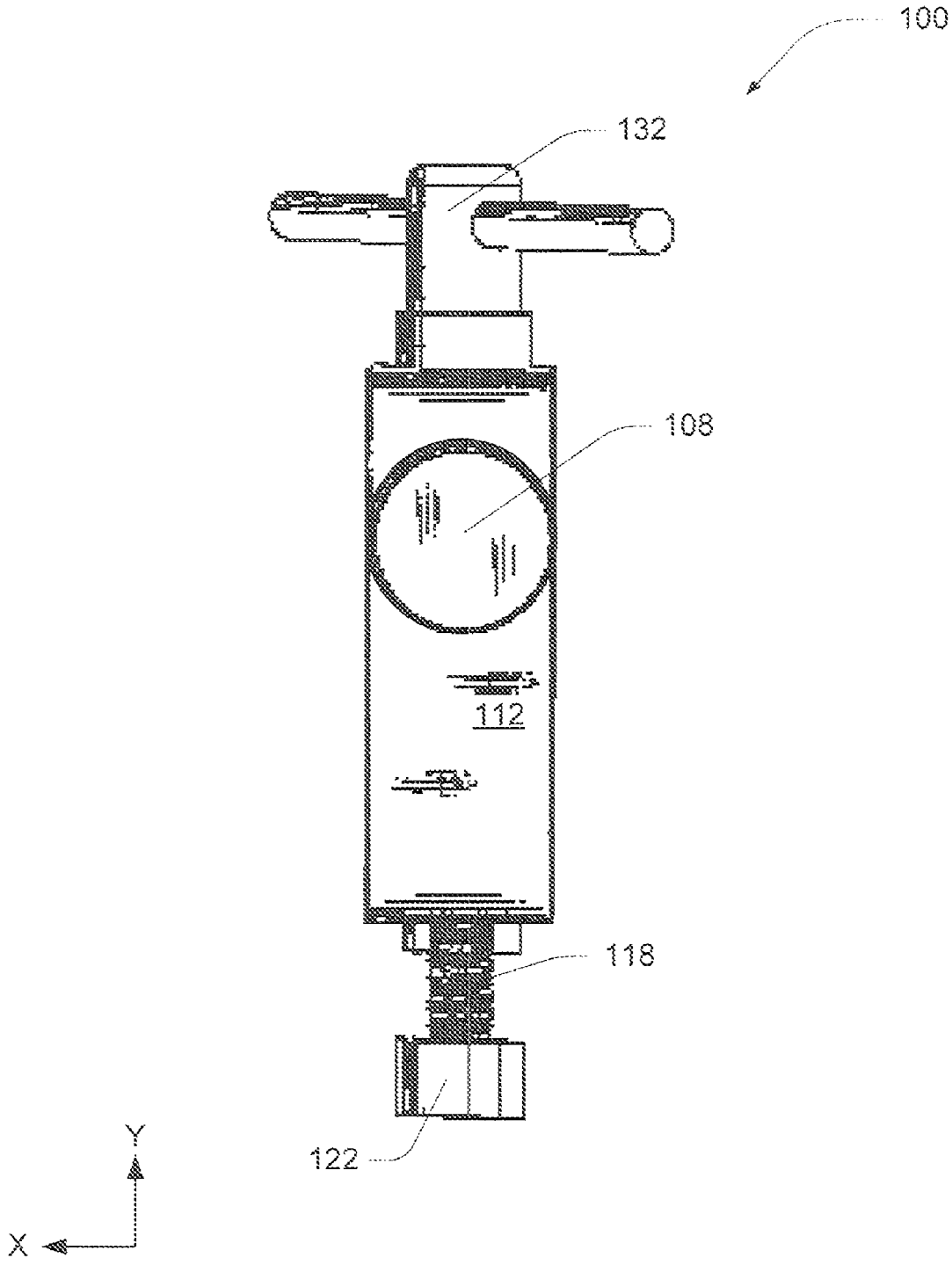
FIG. 5 is a third side view thereof.
Figure 6:
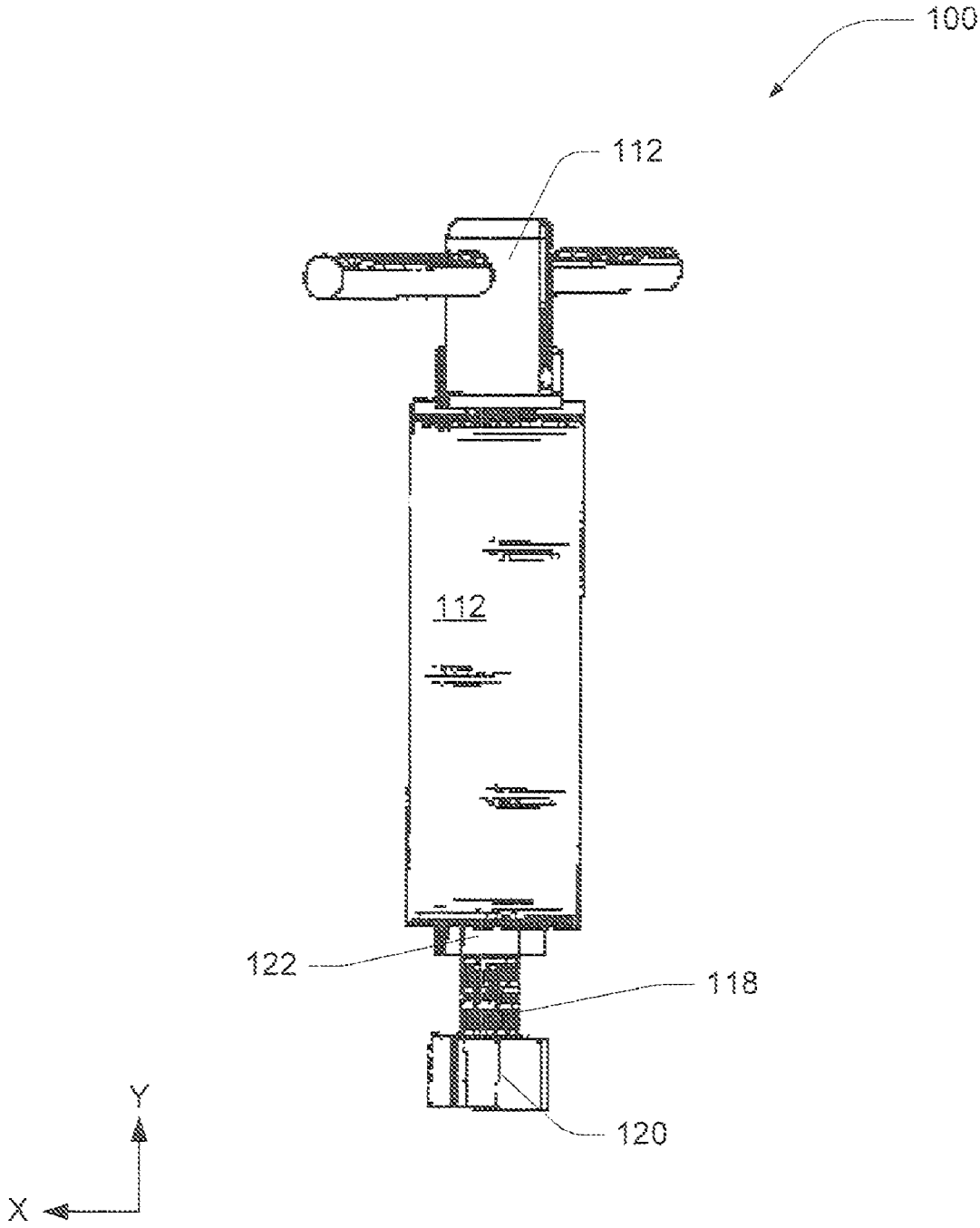
FIG. 6 is a fourth side view thereof.
Figure 11:
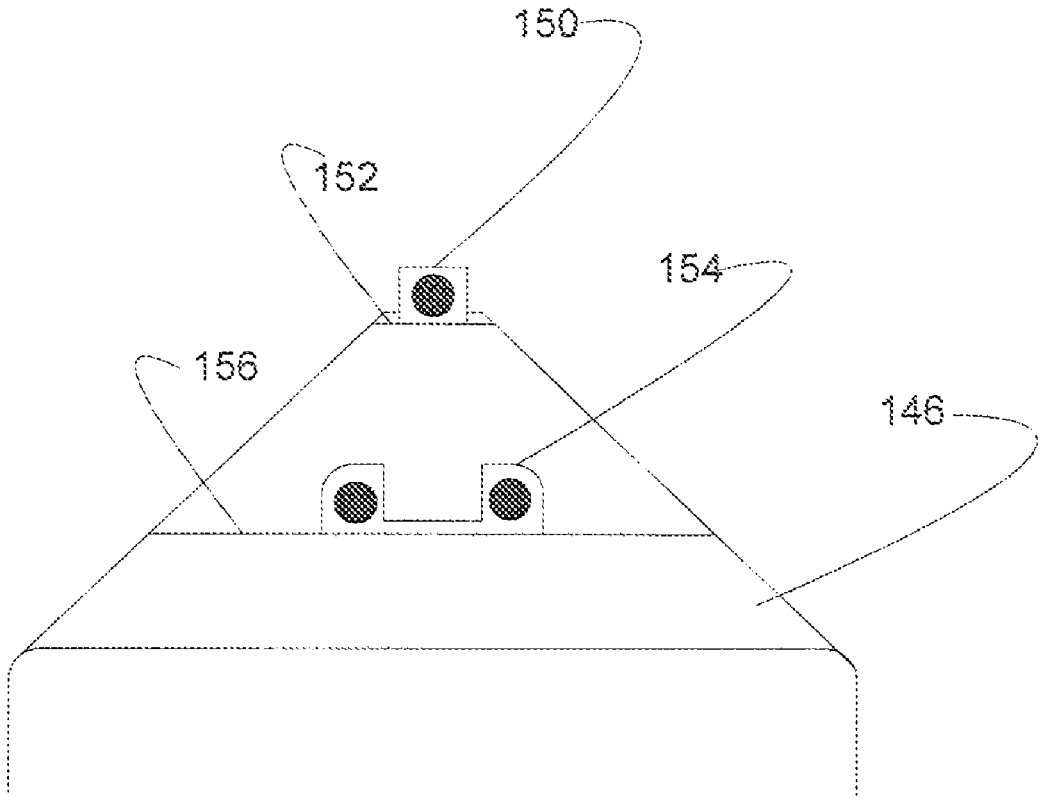
FIG. 11 is an exemplary depiction of a front gun sight and a rear gun sight disposed within dovetail grooves on a slide.

Turning now to FIG. 2, an elevational view of an embodiment of a gun sight adjustment device according to Applicant's invention is presented. FIGS. 1 and 3-6 provide additional views of Applicant's invention. Although Applicant's invention is described herein in terms of adjusting a front sight of a hand gun, Applicant's invention can be used to adjust a rear sight as well. Furthermore, Applicant's invention is capable of adjusting the sights on any type of hand gun where those sights are moveably disposed within a dovetail groove. For example and referring now to FIG. 11, front sight 150 and rear sight 154 are shown disposed on a top surface of slide 146. Front sight 150 is shown moveably disposed within groove 152. Rear sight 154 is shown moveably disposed within groove 156.

As can be seen in the illustrated embodiment of FIG. 2, gun sight adjustment device 100 comprises frame 112, pushing member 102, tail assembly 104, and pressure plate 106. In certain embodiments, frame 112 is 3.5×3.5 inches and comprises hot rolled tubing. In other embodiments, frame 112 is 3×3 inches. In other embodiments, frame 112 comprises aluminum.

Pushing member 102 is moveably disposed on both screw 126 and on guide rod 128, wherein screw 126 and guide rod 128 extend through opposing sides of frame 112. Rotating cross-bar handle 132 in a first direction causes pushing member 102 to move in a first direction along the X-axis shown in FIG. 2. Rotating cross-bar handle 132 in a second and opposite direction causes pushing member 102 to move in a second and opposite direction along the X-axis shown in FIG. 2.

Pushing member 102 is further formed to include opening 140 having at least one protrusion, such as protrusion 124, 130, 152, and/or 154 extending outwardly therefrom. Opening 140 is formed to receive a gun sight. In certain embodiment, pushing member 102 comprises a protrusion to either side of, and defining, opening 140. In certain embodiments, the protrusions are angled inwardly. In certain embodiments, pushing member 102 has a plurality of protrusions, where at least one protrusion comprises a flat distal end and at least one protrusion comprises an angled distal end. In certain embodiment, pushing member 102 comprises any type of steel. In certain embodiments, pushing member 102 comprises 4140 pre-heat treated steel.

In certain embodiments, screw 126 comprises a ⅜-16 screw.

In certain embodiments, screw 118 comprises grade 5 black 4" steel. In certain embodiments screw 118 comprises grade 3 black 4" steel steel. In certain embodiments screw 118 comprises grade 8 black 4" steel steel.

In certain embodiments, guide rod 128 comprises 303 stainless steel. In certain embodiments, guide rod 128 comprises any other type of steel.

In certain embodiments, cross-bar handle 132 comprises aluminum. In certain embodiments, cross-bar handle 132 comprises 303 stainless steel. In certain embodiments, cross-bar handle 132 comprises a combination thereof. In certain embodiments, cross-bar handle 132 comprises any other type of steel.

Tail assembly 104 and pressure plate 106 are positioned within frame 112 such that fixturing surface 114 of tail assembly opposes fixturing surface 116 of pressure plate 106. In certain embodiments, tail assembly 104 and pressure plate 106 comprise the same material. In certain embodiments, tail assembly 104 and pressure plate 106 comprise different materials. In certain embodiments, tail assembly 104 and pressure plate 106 comprise 1018 mild steel. In certain embodiments, tail assembly 104 and pressure plate 106 comprise any other type of steel. In certain embodiments, tail assembly 104 and pressure plate 106 comprise aluminum.

Pressure plate 106 is further disposed on screw 118 and guide rods 138 and 136. Handle 120, when turned, moves pressure plate 106 in the X-direction and towards tail assembly 104, thereby causing an object, such as a gun barrel, placed between pressure plate 106 and tail assembly 104 to press against tail assembly 104 and to be secured therebetween. Guide rods 138 and 136 function to stabilize pressure plate 106 such that pressure plate 106 does not rotate relative to tail assembly 104 when applying pressure to an object therebetween.

In certain embodiments, screw 118 is a 5/16-18 screw. In certain embodiments, screw 118 comprises grade 5 zinc plated 1½" steel. In certain embodiments screw 118 comprises grade 3 zinc plated 1½" steel. In certain embodiments screw 118 comprises grade 8 zinc plated 1½" steel.

In certain embodiments, one or more of fixturing surface 114, fixturing surface 116, tail assembly 104, and/or pressure plate 106, are coated. In such embodiments, fixturing surfaces 114 and 116 are coated with a polyurethane-polyurea elastomer. As will be appreciated by one of ordinary skill in the art, such a coating will prevent the gun slide from being scratched or scored when secured between tail assembly 104 and pressure plate 106.

Figure 7:
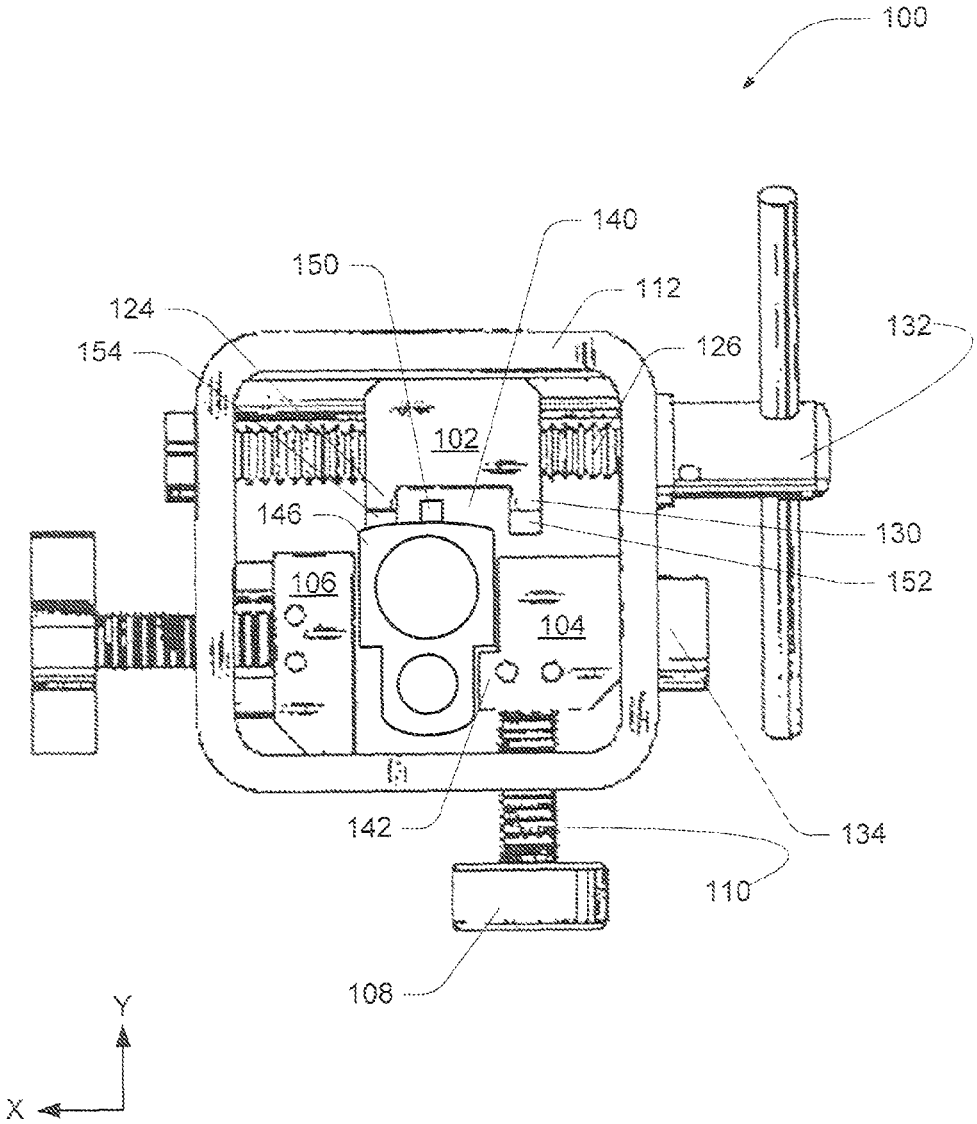
FIG. 7 is an exemplary depiction of a slide having a gun sight secured within the gun sight adjustment device of FIG. 1.

In certain embodiments, tail assembly 104 is further formed to include ledge 144 on fixturing surface 114. Turning to FIG. 7, when gun slide 146 is clamped between pressure plate 106 and tail assembly 104, ledge 144 mates with a recession defined by the slide, as illustrated, thereby further securing the slide and preventing the slide from moving as the sight is adjusted.

As can also be seen in the Illustrated embodiment of FIG. 7, in certain embodiments, tail assembly 104 is further moveably disposed on screw 110, such that rotating screw 110 moves tail assembly 104 in the Y-direction. Thus, when gun slide 146 is secured between pressure plate 106 and tail assembly 104, moving tail assembly in a Y direction can positions a sight, such as sight 150, upwardly or downwardly within opening 140. Lock 134 secure tail assembly 104 after selecting a desired position for sight 150.

In certain embodiments, screw 110 is a 5/16-18 screw. In certain embodiments, screw 110 comprises grade 5 zinc plated 1½" steel. In certain embodiments screw 110 comprises grade 3 zinc plated 1½" steel. In certain embodiments screw 110 comprises grade 8 zinc plated 1½" steel.

As depicted in the illustrated embodiment of FIG. 7, when slide 146 is secured between pressure plate 106 and tail assembly 104, sight 150, here depicted as a front sight, is within opening of 140 of pushing member 102. When cross-bar handle 132 is turned, thereby rotating screw 126, pushing member 102 moves in the X-direction. Protrusion 124, 130, 152, or 154, depending on the direction cross-bar handle 132 is turned, will press against the side of sight 150 and apply pressure. As will be known to one of ordinary skill in the art, sight 150 is positioned within a dovetail grove (not shown) on slide 146, wherein the dovetail grove is cut perpendicular to the length of slide 146. Thus, the pressure applied to sight 150 by protrusion 124, 130, 152, or 154 will push sight 150 linearly within dovetail grove, thereby allowing for the installation, removal, or adjustment, of sight 150.

Figure 9:
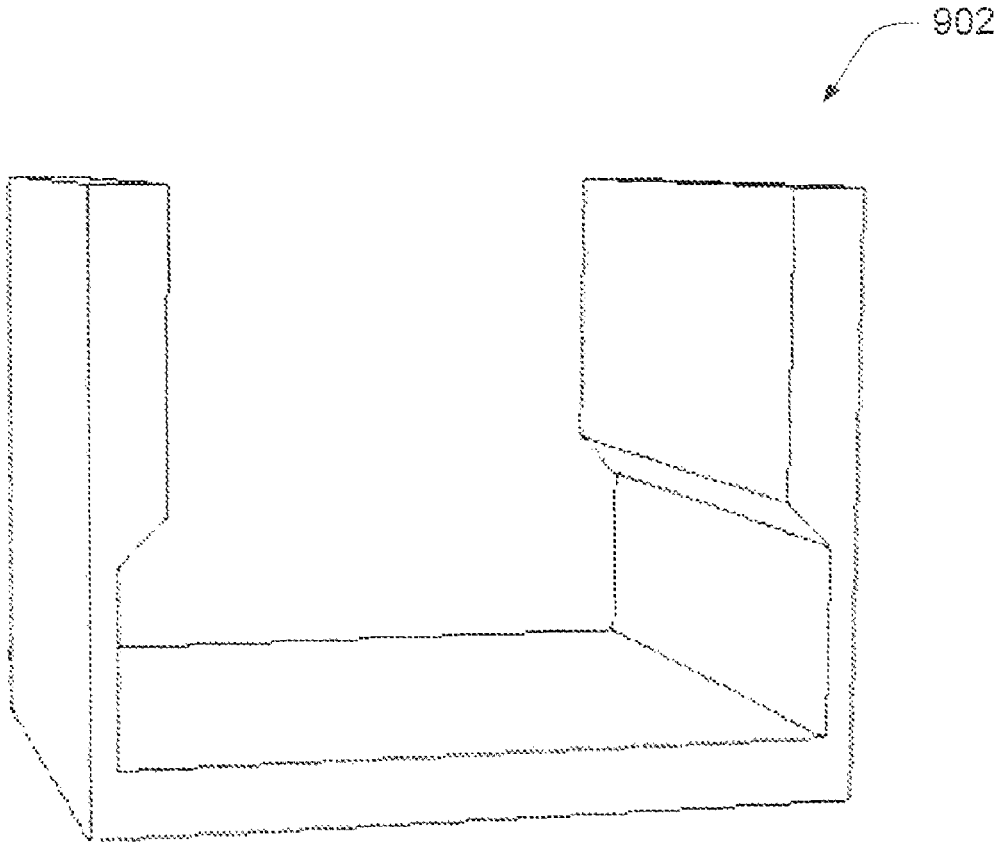
FIG. 9 is a perspective view of an embodiment of a fixture to secure a gun sight within the device of FIG. 1.
Figure 10:
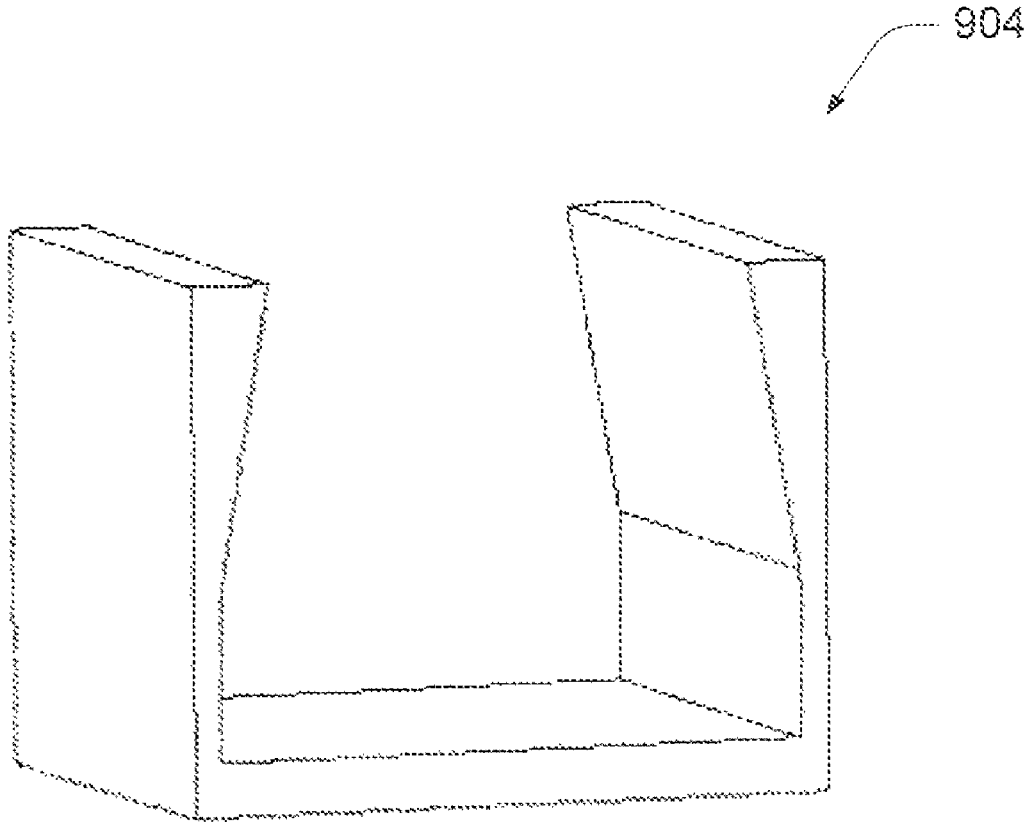
FIG. 10 is a perspective view of an alternative embodiment of a fixture to secure a gun sight within the device of FIG. 1.

In certain embodiments, a fixture is used to secure slide 146 between pressure plate 106 and tail assembly 104, such as step fixture 902 or angle fixture 904 depicted in FIGS. 9 and 10. In such embodiments, step fixture 902 or angle fixture 904 would fit around slide 146 to provide a flat surface for pressure plate 106 and tail assembly 104 to clamp onto. As will be appreciated by one of ordinary skill in the art, fixtures such as step fixture 902 or angle fixture 904 help prevent slide 146 from rotating when pressure is applied to sight 150 by pushing member 102. As will further be appreciated by one of ordinary skill in the art, either step fixture 902 or angle fixture 904 can be used to secure slide 146. It is preferred, however, that the fixture best matching the contour of slide 146 is used.

Figure 8:
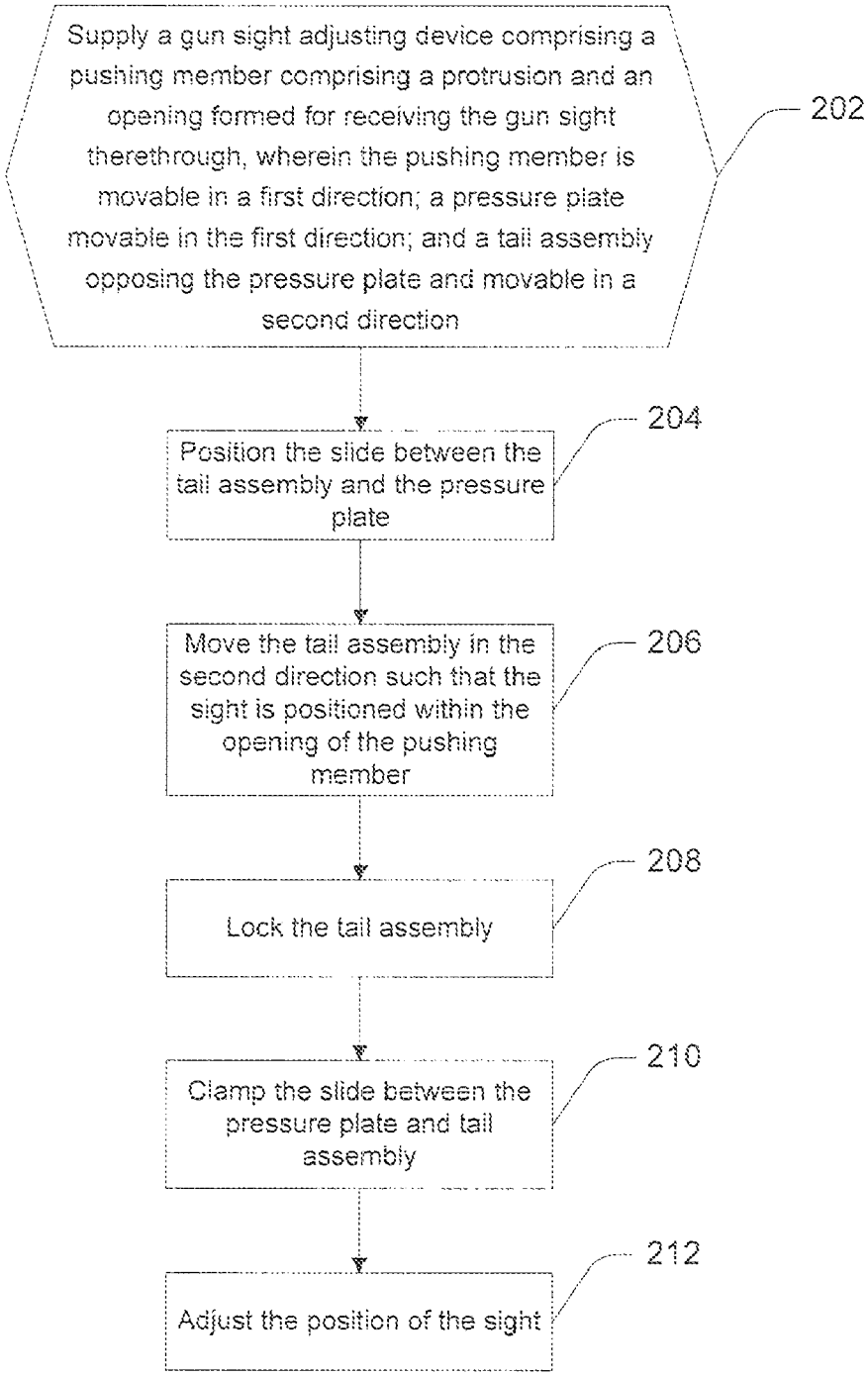
FIG. 8 presents an exemplary flowchart of a method of using Applicant's gun sight adjustment device.

Turning now to FIG. 8, a flow chart of a method of using Applicant's invention is presented. As can be seen in the illustrated embodiment of FIG. 8, to start, a sight adjusting device according to applicant's invention is provided, as indicated by block 202. As indicated by block 204, the slide of a gun is positioned between the tail assembly and the pressure plate such that the sight being installed, removed, or adjusted, is within the opening of the adjusting member. When a sight is being installed, the sight should first be placed at one edge of the dovetail groove such that an edge of the sight is held in place by friction. As will be further appreciated by one of ordinary skill in the art, the slide may be positioned between the tail assembly and the pressure plate such that either protrusions 130 and 124 or protrusions 152 and 154 of pushing member 102 are forward depending on whether the sight being removed or installed is angled.

In certain embodiments, after the sight is situated within the opening of the pushing member, the position of the sight is further adjusted such that the protrusions of the pushing member, such as protrusions 124 and 130 or protrusions 152 and 154 (FIG. 7), intersect with the dovetail of the slide. Optimally, the sight should be positioned such that there is enough clearance between the slide and the protrusions such that the protrusions are able to push against the sight without scraping the slide itself. In certain embodiments, to position the sight, the tail assembly is moved in a second direction either towards or away from the pushing member by rotating the screw the tail assembly is disposed on, as indicated in block 206. In certain embodiments, the tail assembly is then locked into position, as indicated in block 208.

As can be seen in FIG. 7, in certain embodiments, tail assembly 104 includes ledge 144 along fixturing surface 114. Ledge 144 is designed to capture slide 146, where a portion of slide 148 rests on ledge 144 and secures slide 146 such that slide 146 cannot rotate when pressure is applied.

Returning to FIG. 8, once the sight is properly positioned within the opening of the pushing member, the slide can be clamped in place between the pressure plate and tail assembly, as indicated by block 210. To clamp the slide, the pressure plate is moved towards the tail assembly until the slide is secured such that the slide will not rotate. As will be appreciated by one of ordinary skill in the art, the coating disposed on the fixturing surfaces of the tail assembly and pressure plate prevent the slide from being scratched or otherwise damaged when claimed between the tail assembly and pressure plate.

Finally, as indicated by block 212, the position of the sight is adjusted by moving the pushing member such that one of the protrusions of the pushing member pushes against a side of the sight until the sight is installed, removed, or adjusted.

While the preferred embodiments of the present invention have been illustrated in detail, it should be apparent that modifications and adaptations to those embodiments may occur to one skilled in the art without departing from the scope of the present invention.

What is claimed is:

1. A gun sight adjustment device, comprising:

a rectangular frame comprising four sides;

a first rotatable screw extending through a first and an opposing third side, wherein said first rotatable screw is disposed adjacent a second side, wherein said second side interconnects a first end of said first side and a first end of said third side;

a pushing member moveably disposed on said first rotatable screw and comprising a first protrusion extending outwardly therefrom, wherein said pushing member is moveable in a first direction and an opposing second direction;

a second rotatable screw extending through said first side adjacent a fourth side, wherein said fourth side interconnects a second end of said first side and a second end of said third side;

a pressure plate movably disposed on said second rotatable screw within said frame, wherein said pressure plate moveable in said first direction and in said second direction, wherein said pressure plate comprises a first fixturing surface;

a third rotatable screw extending through said fourth side; and a tail assembly movably disposed on said third rotatable screw within said frame, wherein said tail assembly is moveable in a third direction and in an opposing fourth direction, wherein said third and fourth directions are perpendicular to said first and said second directions, wherein said tail assembly comprises a second fixturing surface, wherein said first fixturing surface and said second fixturing surface have a facing relationship.

2. The gun sight adjustment device of claim 1, further comprising a coating disposed on said first fixturing surface and said second fixturing surface.

3. The gun sight adjustment device of claim 2, wherein said coating comprises a polyurethane-polyurea elastomer.

4. The gun sight adjustment device of claim 2, wherein the second fixturing surface comprises a ridge.

5. The gun sight adjustment device of claim 1, further comprising:

a first guide rod parallel extending between said first side and said third side between said first rotatable screw and said second side, wherein said pushing member is moveably disposed on said first guide rod.

6. The gun sight adjustment device of claim 5, further comprising a second guide rod extending through said first side between said second rotatable screw and said fourth side, wherein said pressure plate is moveably disposed on said second guide rod.

7. The gun sight adjustment device of claim 1, wherein said first protrusion comprises a flat distal end.

8. The gun sight adjustment device of claim 1, wherein said first protrusion comprises an angled distal end.

9. The gun sight adjustment device of claim 1, wherein said pushing member further comprises a first end and a second end, wherein said first protrusion extends outwardly from the first end and a second protrusion extends outwardly from the second end, wherein the first protrusion and the second protrusion define an opening.

10. A method of adjusting a sight of a pistol, comprising:

supplying a gun sight adjusting device comprising:

a rectangular frame comprising four sides;

a first rotatable screw extending through a first and an opposing third side, wherein said first rotatable screw is disposed adjacent a second side, wherein said second side interconnects a first end of said first side and a first end of said third side;

a pushing member moveably disposed on said first rotatable screw and comprising a first protrusion extending outwardly therefrom, wherein said pushing member is moveable in a first direction and an opposing second direction;

a second rotatable screw extending through said first side adjacent a fourth side, wherein said fourth side interconnects a second end of said first side and a second end of said third side;

a pressure plate movably disposed on said second rotatable screw within said frame, wherein said pressure plate moveable in said first direction and in said second direction, wherein said pressure plate comprises a first fixturing surface;

a third rotatable screw extending through said fourth side; and a tail assembly movably disposed on said third rotatable screw within said frame, wherein said tail assembly is moveable in a third direction and in an opposing fourth direction, wherein said third and fourth directions are perpendicular to said first and said second directions, wherein said tail assembly comprises a second fixturing surface, wherein first fixturing surface and the second fixturing surface have a facing relationship; and adjusting a position of the sight.

11. The method of claim 10, wherein said pistol comprises a slide, wherein said sight is moveably disposed in a grove formed in a top of the slide, wherein said adjusting further comprises extending said pistol into said gun sight adjustment device such that a portion of said slide is disposed between said pressure plate and said tail assembly.

12. The method of claim 11, wherein said adjusting further comprises fixturing said slide between said pressure plate and said tail assembly.

13. The method of claim 12, wherein said adjusting further comprises positioning, using said tail assembly, said sight in line with said first protrusion.

14. The method of claim 13, wherein said adjusting further comprises bringing said first protrusion into contact with said sight.

15. The method of claim 14, wherein said adjusting further comprising pushing said sight with said first protrusion.

16. The method of claim 11, further comprising:

providing a fixture configured to fit around said slide;

positioning said fixture around said slide; and wherein said fixturing further comprises clamping said fixture between said pressure plate and said tail assembly.

17. The method of claim 11, wherein said adjusting further comprises removing said sight from said grove.

* * * * *